US007550108B2

(12) United States Patent
Denys et al.

(10) Patent No.: US 7,550,108 B2
(45) Date of Patent: Jun. 23, 2009

(54) METALLURGICAL VESSEL

(75) Inventors: Mark Bernard Denys, Amsterdam (NL); Hendrikus Koenraad Albertus Meijer, Uitgeest (NL)

(73) Assignee: Corus Technology BV, Ca Imjuiden (NL)

( * ) Notice: Subject to any disclaimer, the term of this patent is extended or adjusted under 35 U.S.C. 154(b) by 302 days.

(21) Appl. No.: 10/520,480

(22) PCT Filed: Jul. 10, 2003

(86) PCT No.: PCT/EP03/07527

§ 371 (c)(1),
(2), (4) Date: Jun. 21, 2005

(87) PCT Pub. No.: WO2004/007777

PCT Pub. Date: Jan. 22, 2004

(65) Prior Publication Data

US 2005/0284262 A1 Dec. 29, 2005

(30) Foreign Application Priority Data

Jul. 10, 2002 (EP) ..... 02077780
Jul. 10, 2002 (EP) ..... 02077781

(51) Int. Cl.
*C21C 5/32* (2006.01)
*C21B 3/00* (2006.01)

(52) U.S. Cl. ..... 266/225; 266/275

(58) Field of Classification Search ..... 266/225, 266/275

See application file for complete search history.

(56) References Cited

U.S. PATENT DOCUMENTS

| | | | | |
|---|---|---|---|---|
| 4,195,985 | A | 4/1980 | Brotzmann | |
| 4,248,408 | A * | 2/1981 | Beggs et al. | 266/156 |
| 4,399,983 | A | 8/1983 | Metz | |
| 4,852,858 | A | 8/1989 | Weber | |
| 5,201,941 | A | 4/1993 | Wells | |
| 5,662,860 | A | 9/1997 | Klaassen et al. | |
| 5,681,526 | A | 10/1997 | Zhang | |
| 5,733,358 | A * | 3/1998 | Geiger et al. | 75/501 |
| 5,769,923 | A * | 6/1998 | Nishikawa et al. | 75/553 |
| 6,368,548 | B1 | 4/2002 | Innes | |
| 6,440,195 | B1 | 8/2002 | Dry | |

FOREIGN PATENT DOCUMENTS

| | | |
|---|---|---|
| EP | 0735146 | 10/1996 |
| EP | 0756012 | 1/1997 |
| WO | 9106683 | 5/1991 |
| WO | 0022176 | 4/2000 |

* cited by examiner

*Primary Examiner*—Roy King
*Assistant Examiner*—Caitlin Fogarty
(74) *Attorney, Agent, or Firm*—Novak Druce + Quigg LLP

(57) ABSTRACT

Metallurgical vessel for iron and steel making including a bottom portion, a sidewall and a lance arrangement of at least two lances for supplying oxygen containing gas to the interior of the vessel in operation. Each lance includes an end portion for emitting oxygen containing gas. The lance arrangement is configured so as to achieve in operation a substantially downwardly directed flow of post-combusted gases at the side wall of the vessel and a substantially upwardly directed flow of post-combusted gases in the center of the vessel.

10 Claims, 5 Drawing Sheets

METALLURGICAL VESSEL

This application is a §371 National Stage Application of International Application No. PCT/EP2003/007527, filed on 10 Jul. 2003, claiming the priority of European Patent Application No. 02077780.1 filed on 10 Jul. 2002 and EP 020777810.9 filed on 10 Jul. 2002.

The present invention relates to a metallurgical vessel for iron and steel making comprising a bottom portion, a sidewall and a lance arrangement of at least two lances for supplying oxygen containing gas to the interior of the vessel in operation wherein each lance comprises an end portion for emitting oxygen containing gas. The present invention also relates to methods of iron making.

The object of the present invention is to provide a metallurgical vessel which can be used on a large scale with increased production efficiency and reduced clogging of equipment positioned in a roof portion of the vessel.

The present invention improves on the prior art as the lance arrangement is configured so as to achieve in operation a substantially downwardly directed flow of post-combusted gases at the side wall of the vessel and a substantially upwardly directed flow of post-combusted gases in the centre of the vessel.

The term post-combusted gases refers to the gases which are produced during reactions in the metallurgical vessel and are subsequently at least partially post combusted. The term centre of the vessel refers to the central column area of the vessel surrounding and including the central axis of the vessel. When the metallurgical vessel is upright the central axis extends essentially vertically through the centre of the vessel.

The present invention has the considerable advantage that it can be successfully used for vessels of large diameter by stimulating what has been found to be a very favourable gas flow in the body of the vessel. The gas flow results in reduced heat loads on the walls whilst the plurality of lances ensure a good distribution of oxygen containing gas and therefore good heat distribution over the vessel area, thereby increasing production efficiency. The present invention also mitigates the problem of clogging of and damage to, e.g. ports, seals, sensors and measuring equipment positioned in the roof portion of the vessel which are expensive and difficult to replace or repair. This problem of clogging arises when particulates are entrained in the upward flow of post combusted gases directed to the roof portion of the vessel. The lance configuration of the present invention creates a substantially downward flow of post combusted gases at the sidewall whilst the substantially upwardly directed flow occurs at the centre of the vessel. Any particulates entrained in the upward flow therefore pass up the centre of the vessel and have less chance of coming into contact with any of the equipment, ports, seals or sensors projecting through the roof. Examples of processes for producing molten metal directly from metal oxides include the use of electric furnaces as the major source of energy for the smelting reactions, the Romelt process, the DIOS process, the AISI process, the Hismelt process and using a cyclone convertor furnace.

EP 0 735 146 discloses a metallurgical vessel of the converter type in which pre-reduced iron ore undergoes a final reduction. The bottom portion of the metallurgical vessel contains the iron bath whilst the wall or side wall extends upwardly from the bottom portion, enclosing the slag layer. The roof portion extends from the top of the sidewall over the interior of the vessel and connects with the melting cyclone. A plurality of lances project through the wall of the metallurgical vessel and supply oxygen to the interior of the vessel.

The lances are specified as being orientated vertically as much as possible in order to achieve the same effect as when using a central lance.

As mentioned above the present invention improves on the prior art as the lances are configured so as to achieve in operation a substantially downwardly directed flow of post-combusted gases at the side wall of the vessel and a substantially upwardly directed flow of post-combusted gases in the centre of the vessel. The substantially downwardly directed flow of post-combusted gases at the side wall of the vessel and a substantially upwardly directed flow of post-combusted gases in the centre of the vessel achieved in operation can be directly and positively verified by a person skilled in the art by, for example, calculating and monitoring the heat losses per square meter in the side wall and roof portion of the vessel.

The side walls and roof section of a metallurgical vessel may comprise metal staves or tubes through which water flows for the purpose of cooling the vessel and/or refractory material that can withstand high temperatures. The side wall and roof section of a metallurgical vessel are usually equipped with temperature sensors.

The temperature sensors may be thermocouples that measure the cooling water temperature or thermocouples that measure the refractory wall temperature in various parts along the height and circumference of the side wall and roof portions of the vessel. When the cooling water temperature measurement is combined with a cooling water flow measurement, a person skilled in the art can calculate and monitor the heat losses per square meter (heat fluxes) in different parts along the height and circumference of the side wall and roof portions of the vessel. The skilled person can thus verify whether there is in operation a substantially downwardly directed flow of post-combusted gases at the side wall of the vessel and a substantially upwardly directed flow of post-combusted gases in the centre of the vessel by monitoring the side wall and roof portion temperatures of the vessel.

In a conventional metallurgical vessel with a single central lance or vertically orientated lances the combustion created by the lance(s), creates a strong expansion of gases in the centre of the vessel that leads to a flow of hot combustion off gases towards and up the side walls.

In a metallurgical vessel according to the present invention the substantially downwardly directed flow of post-combusted gases at the side wall of the vessel has a cooling effect on the side wall and thus results in lower refractory temperatures or heat fluxes. The hot post combusted gases flow substantially upwardly through the centre of the vessel and thus do not contact the side wall. The present invention also results in a decrease in refractory temperatures or heat fluxes particularly in the area of the side wall in the vicinity of the lances.

In the metallurgical vessel of the present invention at least one of the lances may be provided with means for emitting a plurality of jets of oxygen containing gas from its end portion. Such a lance can emit oxygen over a wider surface area of the contents of the vessel compared to a single jet Each of the lances may be provided with means for emitting a plurality of jets of oxygen containing gas from its end portion.

The lances are preferably configured with at least one of the lances projecting through the roof portion of the metallurgical vessel. The roof portion of the vessel extends from the top of the sidewall. If a melting cyclone is positioned above and in open communication with the vessel then the roof portion extends from the top of the sidewall to the melting cyclone. At least one of the lances thus penetrates through part of the vessel that does not come into contact with the contents of the vessel thereby avoiding damage to the seal around the lance at the point it penetrates the vessel. Each of the lances may project through a roof portion of the metallurgical vessel.

At least one lance is preferably arranged to direct the oxygen containing gas inwards towards the central axis of the metallurgical vessel. Each of the lances may be arranged to direct the oxygen containing gas inwards towards the central axis of the metallurgical vessel. Directing the gas inwards towards the central axis of the vessel creates an area of low pressure at the lance end portion resulting in post combusted gas being entrained downward at the sidewall towards the end portion of the lance whilst an upward flow of post combusted gas is generated up through the centre of the vessel.

At least one of the lances may be inclined from the vertical under a first acute angle with its end portion inclined towards the central axis of the metallurgical vessel. Inclining a lance directs the oxygen containing gas inwards towards the central axis of the metallurgical vessel and improves the distribution of oxygen containing gas over the surface of the contents of the vessel. Each of the lances may be inclined from the vertical with its end portion inclined towards the central axis of the metallurgical vessel.

The end portion of at least one lance may also be configured to direct the oxygen containing gas towards the central axis of the metallurgical vessel under a second acute angle from the vertical which second acute is greater than the first acute angle. The greater angle from the vertical than the angle of inclination of the lance increases the upward and downward gas flow generated in the vessel. Each of the lances may be configured to direct the oxygen containing gas towards the central axis of the metallurgical vessel at a greater angle from the vertical than the angle of inclination of the lance.

The lances may be adjustable in height and therefore able to be positioned at an optimal height over the surface of the of the vessel contents when the vessel is at varying levels of fullness. The angle of inclination of the lances may also be adjustable to enable the distribution of oxygen containing gas over the surface of the contents of the vessel to be optimised.

The lance end portions may all be positioned at an equal distance from the sidewall to achieve the most effective heat distribution over the surface of the vessel contents to maximise production efficiency. Preferably three or more lances supply oxygen containing gas to the contents of the vessel to ensure optimum heat distribution and production efficiency.

Particulate material may preferably be added to the metallurgical vessel via at least one feed chute in the substantially downwardly directed flow of post-combined gases which feed chute is positioned at a short distance from the lances. The substantially downward gas flow in the vicinity of the sidewall thus entrains the particulate material in the form of e.g. coal fines and transports it down towards the end portions of the oxygen lances and the slag layer. This avoids the problem of a significant proportion of any particulate material added to the vessel being lost, due to particles being entrained in the upward gas flow, before reacting with the contents of the vessel. The preferred embodiment thus results in a significantly lower loss of particulate material, such as coal fines, from the vessel and a higher production efficiency as a greater proportion of the particulate material is available as a reactant. The gas leaving the metallurgical vessel in operation (off gas) can be sampled, as is known in the art, to verify the reduction in particulate material in the off gas. The combustion degree of the off gas will also improve as the coal pyrolysis products, which evolve spontaneously when coal comes into the hot atmosphere inside the metallurgical vessel during operation, will be entrained in the downward flow of gas at the side wall and will be combusted rather than being blown out of the vessel. The combustion degree of the off gas can also be ascertained by off gas sampling and analysis as is known in the art.

The loss of particulate material is further minimised if each lance has a corresponding feed chute so that the particulate material added through the chute is entrained into the substantially downward gas flow. The optimal position for each chute is to be positioned between the lance and the sidewall of the metallurgical vessel, in a radial direction, where the substantially downward flow of the post combusted gases is at a maximum.

The sidewall of the vessel preferably comprises a lower portion for accommodating a molten metal bath and part of a slag layer in use and an upper portion for accommodating the remainder of the slag layer in use, wherein the at least two lances project into the upper portion of the vessel and supply oxygen containing gas to the upper portion of the vessel and wherein a plurality of tuyeres are arranged around the circumference of the lower portion of the vessel suitable for supplying gas and/or liquid and/or solids and/or plasma into the slag layer in the lower portion of the vessel. The at least two lances supply oxygen containing gas, and thereby heat, to the slag in the upper portion of the vessel whilst the gas and/or liquid and/or solids and/or plasma supplied by the tuyeres ensure that the lower slag layer does not become quiescent. Quiescence results in a cooling of the lower slag layer and a loss of productivity.

The tuyeres supply gas and/or liquid and/or solids and/or plasma directly to the lower slag layer whereas gas is injected through the bottom of the vessel into the molten metal in bottom stirring. The preferable aspect of the invention thus does not generate high flow velocities in the molten metal thereby avoiding one of the major drawbacks of bottom stirring namely the fast erosion of the vessel wall in the part of the vessel containing the molten metal. The supply of gas and/or liquid and/or solids and/or plasma to the slag layer in the lower portion of the vessel by the tuyeres thus does not cause erosion of the refractory lining in the hot metal zone but it does maintain productivity by stirring the lower slag layer. Stirring the lower slag layer maximises reactions within the lower slag layer and ensures it does not become quiescent. The supply of combustible gas and/or liquid and/or solids by the tuyeres also increases heat transfer from the slag layer to the molten metal in the lower portion of the vessel. The tuyeres are also easier to maintain as they are positioned above the tap level of the vessel.

The diameter of the lower portion of the metallurgical vessel is preferably smaller than that of the upper portion. The tuyeres are arranged around the circumference of the lower part of the vessel and therefore the jets emitted by the tuyeres will penetrate into the slag layer in the lower portion of the vessel before rising through the slag into the upper portion of the vessel. Any "hot spots" i.e. areas of higher temperature, created by the gas and/or liquid and/or solids and/or plasma supplied by the tuyeres, in the slag layer in the upper portion of the vessel will therefore be sufficiently distant from the wall of the vessel to ensure that no increase in corrosion and/or erosion of the wall occurs.

The tuyeres may preferably comprise oxy-fuel burners to act as a direct heat source in the slag layer in the lower portion of the vessel. The oxy-fuel burners will increase the productivity of the reactor by increasing the occurrence of the endothermic reduction reactions and thereby increasing the reduction capacity of the slag layer.

The metallurgical vessel of the present invention preferably comprises a melting cyclone positioned above, and in open communication with, the vessel. None of the oxygen lances thus has to withstand the heat and corrosive environment of the cyclone as they do not extend through the cyclone. Such a melting cyclone is disclosed in Dutch patent NL C 257692 and EP 0735146.

The lances are preferably positioned to avoid contact with molten material passing downwards from the melting cyclone to the metallurgical vessel so that the molten material does not damage the lances. Replacement and/or repair of damaged lances is costly and reduces production efficiency.

The present invention also relates to a method of reducing iron oxide into iron using a metallurgical vessel in accordance with the invention and comprising the steps of supplying iron oxides to the vessel and reducing the iron oxides by supplying carbonaceous material to the vessel and supplying oxygen containing gas to the iron oxides via lances. The oxygen containing gas may be supplied to the upper portion of the metallurgical vessel via the lances, and gas and/or liquid and/or solids and/or plasma may be supplied into the slag layer in the lower portion of the vessel via the plurality of tuyeres.

The present invention also relates to a method of iron making comprising the steps of:

- conveying iron oxide or pre-reduced iron oxide into a metallurgical vessel,
- supplying oxygen containing gas to the metallurgical vessel via a lance arrangement of at least two lances configured so as to achieve in operation a substantially downwardly directed flow of post-combusted gases at the side wall of the vessel and a substantially upwardly directed flow of post-combusted gases in the centre of the vessel,
- supplying carbonaceous material to the vessel.

The present invention also relates to a method of iron making in accordance with the method above comprising the steps of:

- conveying iron-oxide containing material into a melting cyclone,
- pre-reducing said iron-oxide containing material by means of reducing post combusted gases originating from the metallurgical vessel,
- at least partly melting the iron-oxide containing material in the melting cyclone by supplying oxygen containing gas to the melting cyclone and effecting a further post combustion in said reducing post combusted gases,
- permitting the pre-reduced and at least partly melted iron-oxide containing material to pass downwardly from said melting cyclone into the metallurgical vessel in which final reduction takes place and
- effecting the final reduction in the metallurgical vessel in a slag layer by supplying oxygen containing gas to the metallurgical vessel, via the lances, and supplying coal to the metallurgical vessel and thereby forming a reducing gas and effecting at least partial post combustion in said reducing gas in said metallurgical vessel by means of said oxygen containing gas supplied thereto.

The present invention preferably relates to a method of iron making as set out above including the step of:

- supplying gas and/or liquid and/or solids and/or plasma into a slag layer in a lower portion of the vessel.

An alternative metallurgical vessel may comprise a lower portion for accommodating a molten metal bath and part of a slag layer in use, an upper portion for accommodating the remainder of the slag layer in use and a plurality of lances which project into the upper portion of the vessel and supply oxygen containing gas to the upper portion of the vessel characterised in that a plurality of tuyeres are arranged around the circumference of the lower portion of the vessel suitable for supplying gas and/or liquid and/or solids and/or plasma into the slag layer in the lower portion of the vessel.

The plurality of lances supply oxygen containing gas, and thereby heat, to the slag in the upper portion of the vessel whilst the gas and/or liquid and/or solids and/or plasma supplied by the tuyeres ensure that the lower slag layer does not become quiescent. Quiescence results in a cooling of the lower slag layer and a loss of productivity. The tuyeres supply gas and/or liquid and/or solids and/or plasma directly to the lower slag layer whereas gas is injected through the bottom of the vessel into the molten metal in bottom stirring. The preferable aspect of the invention thus does not generate high flow velocities in the molten metal thereby avoiding one of the major drawbacks of bottom stirring namely the fast erosion of the vessel wall in the part of the vessel containing the molten metal.

The supply of gas and/or liquid and/or solids and/or plasma to the slag layer in the lower portion of the vessel by the tuyeres thus does not cause erosion of the refractory lining in the hot metal zone but it does maintain productivity by stirring the lower slag layer. Stirring the lower slag layer maximises reactions within the lower slag layer and ensures it does not become quiescent. The supply of combustible gas and/or liquid and/or solids by the tuyeres also increases heat transfer from the slag layer to the molten metal in the lower portion of the vessel. The tuyeres are also easier to maintain as they are positioned above the tap level of the vessel.

The diameter of the lower portion of the metallurgical vessel is preferably smaller than that of the upper portion. The tuyeres are arranged around the circumference of the lower part of the vessel and therefore the jets emitted by the tuyeres will penetrate into the slag layer in the lower portion of the vessel before rising through the slag into the upper portion of the vessel. Any "hot spots" i.e. areas of higher temperature, created by the gas and/or liquid and/or solids and/or plasma supplied by the tuyeres, in the slag layer in the upper portion of the vessel will therefore be sufficiently distant from the wall of the vessel to ensure that no increase in corrosion and/or erosion of the wall occurs.

The tuyeres may preferably comprise oxy-fuel burners to act as a direct heat source in the slag layer in the lower portion of the vessel. The oxy-fuel burners will increase the productivity of the reactor by increasing the occurrence of the endothermic reduction reactions and thereby increasing the reduction capacity of the slag layer.

BRIEF INTRODUCTION TO THE DRAWINGS

Embodiments of the invention will now be described by way of non-limitative examples, with reference to the accompanying drawings, in which.

DESCRIPTION OF A PREFERRED EMBODIMENT

Figure 1:
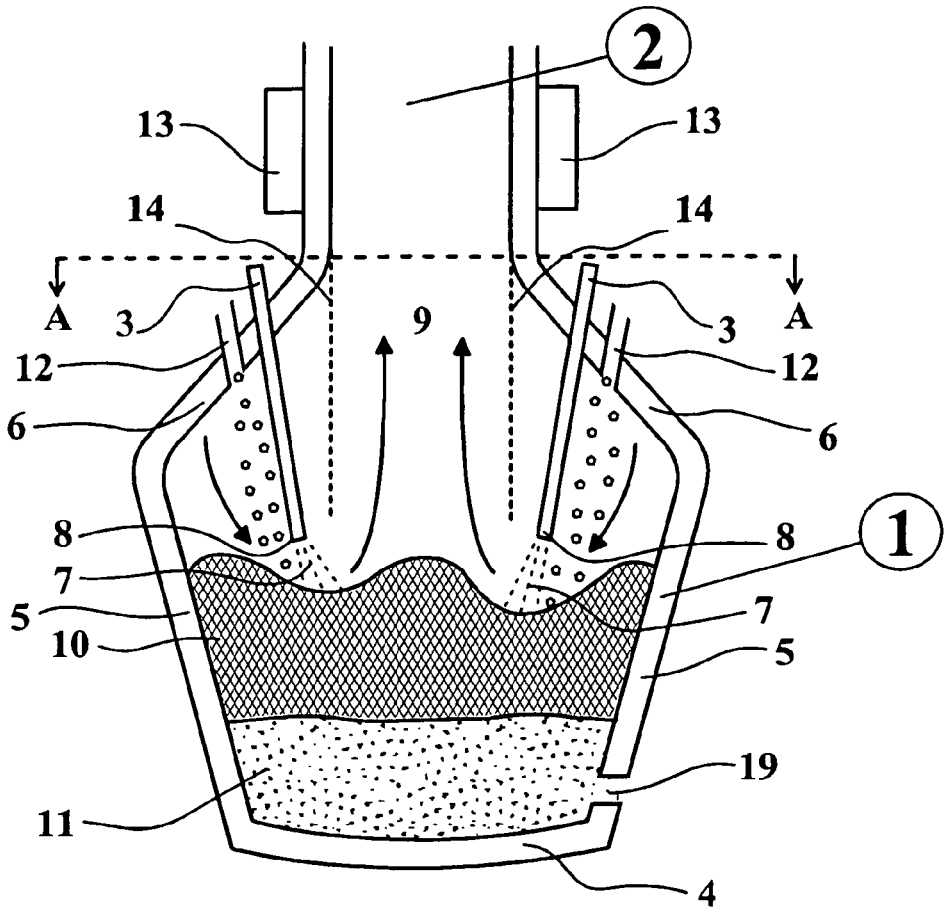
FIG. 1 shows an apparatus in accordance with the invention.

The apparatus in FIG. 1 comprises a metallurgical vessel 1, a melting cyclone 2 (details not shown) and a plurality of lances 3, of which two are shown. More lances may be used depending on, for example, the size of the vessel and the performance parameters of the lances. The metallurgical vessel itself comprises a bottom portion 4, a sidewall 5 and a roof portion 6 which extends from the top of the sidewall 5 to the melting cyclone 2. The metallurgical vessel contains an iron bath 11 with a slag layer 10 on top and the vessel comprises at least one tap hole 19 for tapping off molten iron and slag.

Oxygen containing gas is supplied to the interior of the vessel by the lances 3 which acts to finally reduce the pre-reduced iron oxide in the slag layer. During the final reduction a process gas comprising reducing carbon monoxide is produced and at least partially combusted above the slag layer 10, thereby releasing heat needed for the final reduction. The at least partially post combusted gas resulting from the post combustion is referred to as post combusted gas. Particulate coal is supplied to the interior of the vessel 1 via the feed chutes 12. The lances 3 project into the vessel through the roof 6 and are configured to create a substantially downwardly directed flow of the post-combusted gas at the sidewall 5 of the vessel and a substantially upwardly directed flow of post combusted gas in the centre of the vessel 9. The upwardly directed post combusted gas, comprising reducing carbon monoxide, is further post-combusted in the melting cyclone 2 with oxygen containing gas supplied to the melting cyclone. Iron oxide supplied to the melting cyclone via apparatus 13 is pre-reduced approximately to FeO and at least partly melted. The pre-reduced iron oxide 14 then falls or flows down into the metallurgical vessel 1. When the metallurgical vessel is upright the central axis extends essentially vertically through the centre of the vessel.

During operation the lances extend to above the slag layer 10 and the lances are adjustable in height so they can be positioned optimally for supplying oxygen containing gas even when the vessel is at varying levels of fullness. The lances 3 are inclined from the vertical and the end portions 8 are configured to direct a jet 7 or jets of oxygen containing gas towards the centre of the vessel either at the same inclination of the lance or at greater angle from the vertical than the inclination of the lance.

Figure 5:
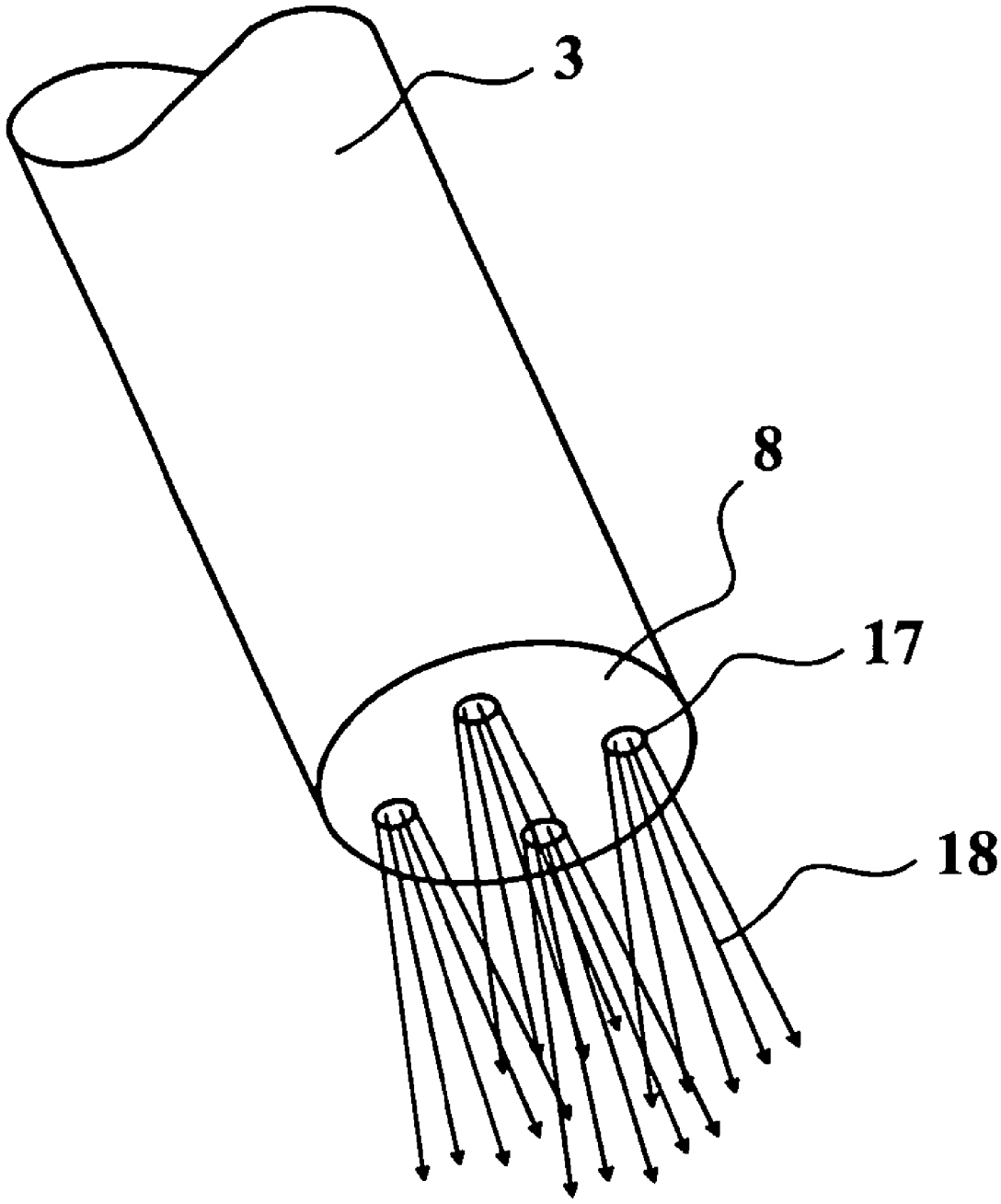
FIG. 5 shows a lance end portion having four ports for emitting four jets of oxygen containing gas.

FIG. 5 shows in detail the end portion 8 of a lance 3 having four ports 17 which emit four jets 18 of oxygen containing gas. The lances 3 are positioned so that their ends are all of equal distance from the sidewall. The number of lances projecting into the vessel can be varied depending on the size of the metallurgical vessel and the surface area of slag covered by each lance. The number of ports in the end portion of the lances can also be varied.

Figure 2:
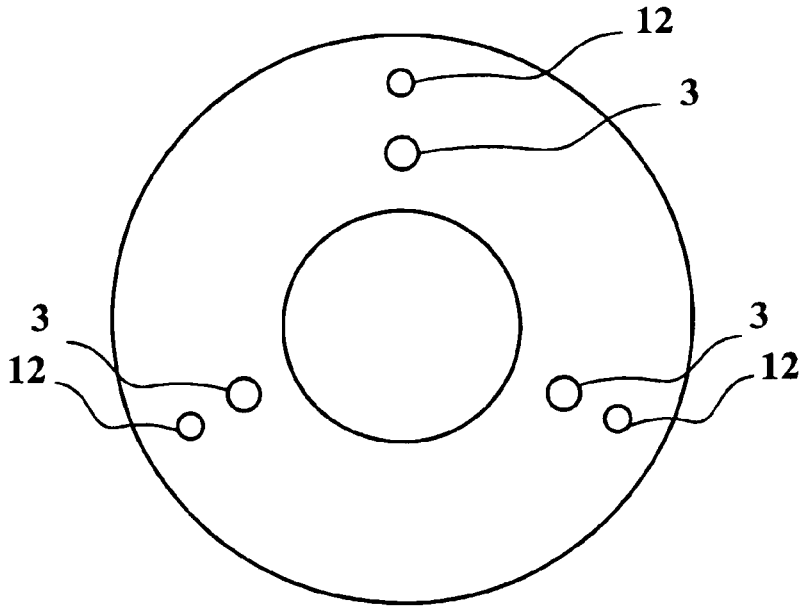
FIG. 2 shows a view along axis "A" of FIG. 1.

FIG. 2 shows the positions of the three feed chutes 12 with respect to the three oxygen lances 3 of FIG. 1.

Figure 3:
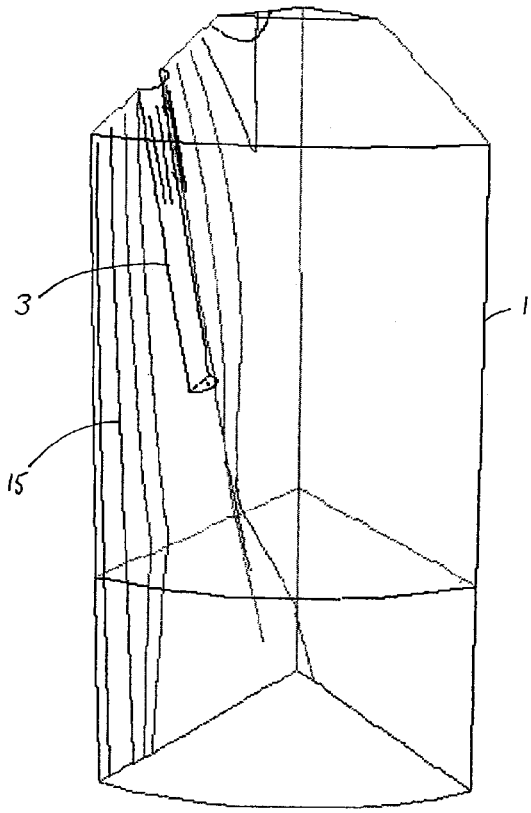
FIG. 3 shows a simulation of a section of the apparatus with one lance projecting into the vessel section and shows the simulated trajectory of coal particles added at a short distance from the lance.
Figure 4:
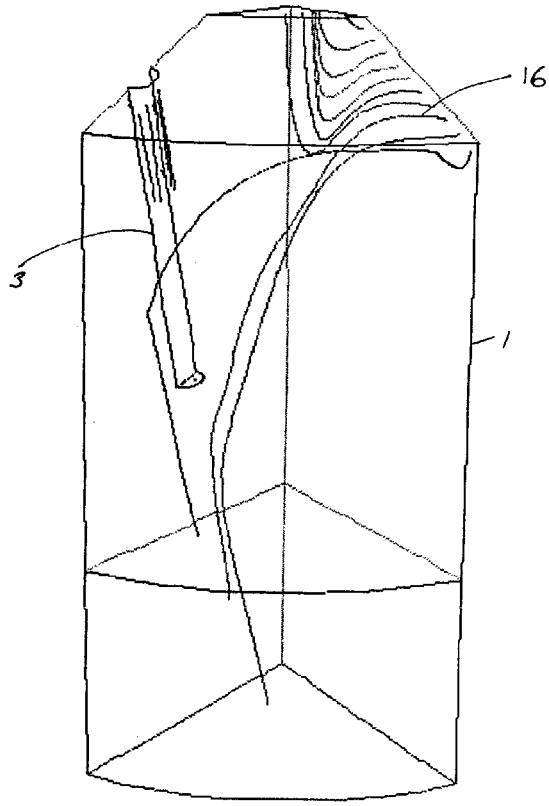
FIG. 4 shows simulation of a section of the apparatus with one lance projecting into the vessel section and shows the simulated trajectory of coal particles added between the lances.

FIG. 3 shows a section of the vessel 1, a lance 3 projecting into the section of the vessel and the trajectories 15 of coal particles added to the vessel. The advantage obtained by adding coal particles a short distance from the lances is clear as the particles are entrained towards the slag layer with the substantially downward flow of post-combusted gases at the sidewall of the vessel. In contrast, FIG. 4 shows the trajectories 16 of coal particles added between the lances. It can be seen that the majority of the particles are entrained in the upwardly directed flow of post-combusted gases in the centre of the vessel and leave the vessel. A significant proportion of the coal particles added thus never become available as reactants in the slag layer.

Figure 6:
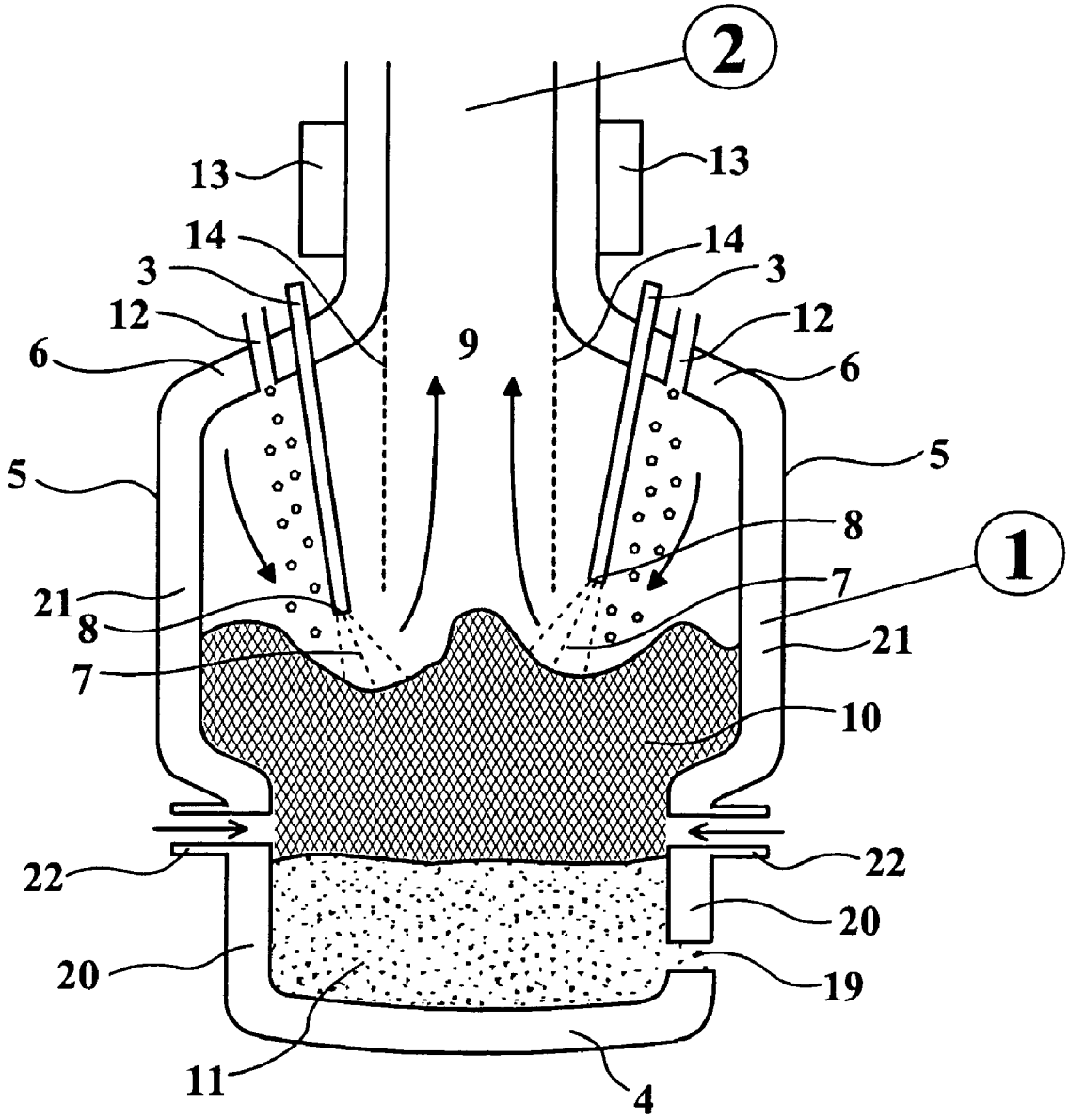
FIG. 6 shows a particular embodiment of the invention.

FIG. 6 shows a metallurgical vessel 1, a melting cyclone 2 (details not shown) and a plurality of lances 3, of which two are shown. The lances 3 project into the vessel through the roof 6 and are configured to create a downwardly directed flow of the post-combusted gas at the sidewall 5 of the vessel and an upwardly directed flow of post combusted gas in the centre of the vessel 9. The lances 3 are inclined from the vertical and the end portions 8 are configured to direct a jet 7 or jets of oxygen containing gas towards the centre of the vessel either at the same inclination of the lance or at greater angle from the vertical than the inclination of the lance. The side wall 5 of the metallurgical vessel comprises an upper portion 21 and a lower portion 20. The lower portion 20 accommodates the molten metal bath 11 and part of the slag layer 10 in use. The upper portion 21 accommodates the remainder of the slag layer in use and the lances 3 project into the upper portion of the vessel and supply oxygen containing gas to the slag layer 6 in the upper portion 3 of the vessel. A plurality of tuyeres 22 (of which two are shown) are arranged around the circumference of the lower portion of the vessel suitable for supplying gas and/or liquid and/or solids (such as recycled dust) and/or plasma into the slag layer in the lower portion 20 of the vessel. The number of tuyeres arranged around the circumference of the lower part of the vessel can be varied depending on the size of the vessel and the performance parameters of the tuyeres. The tuyeres may comprise oxy-fuel burners. The remainder of the details in FIG. 6 are in accordance with and numbered as the features illustrated in FIGS. 1-5 and described above.

Figure 7:
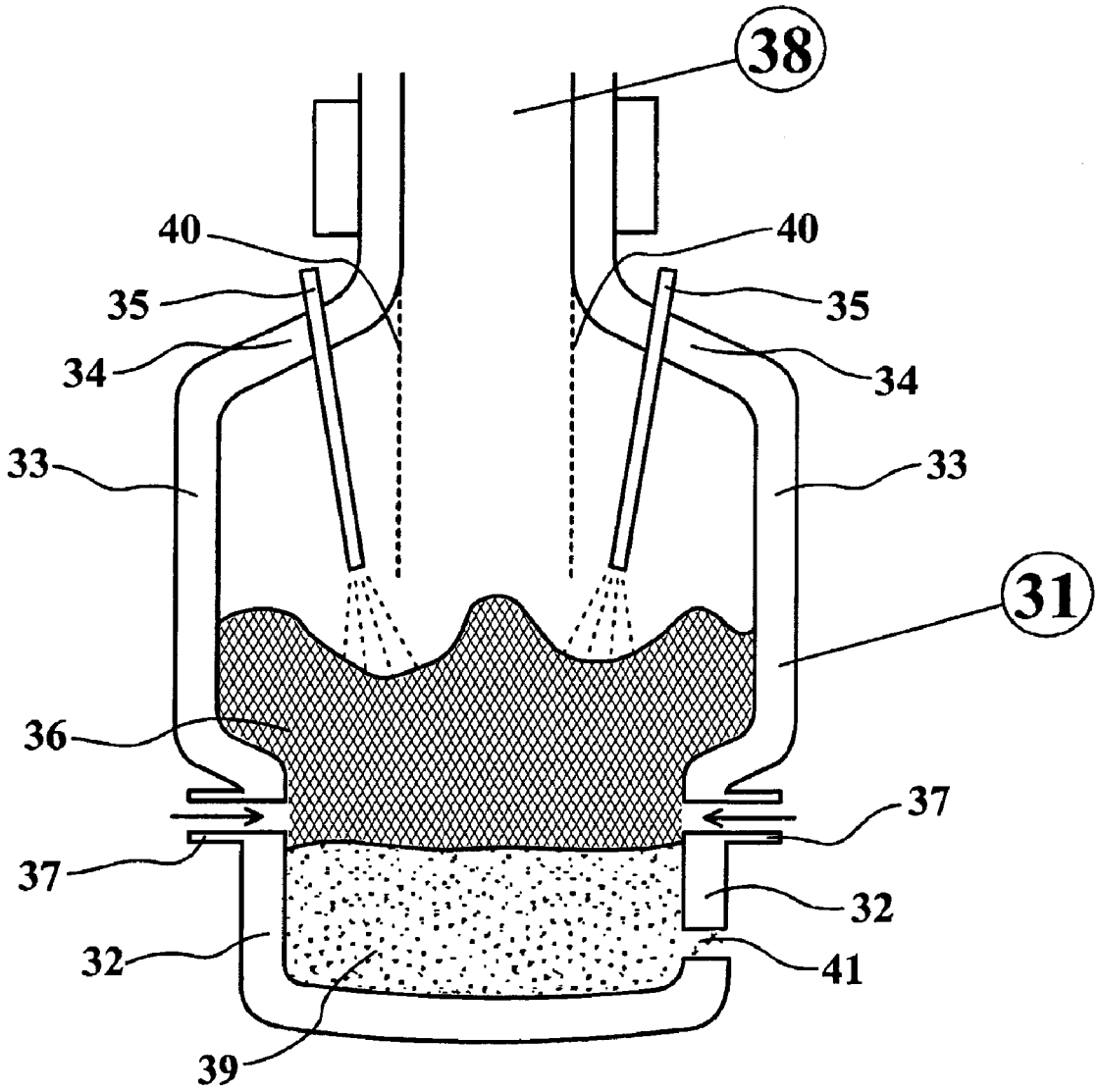
FIG. 7 shows the alternative metallurgical vessel.

FIG. 7 shows the alternative metallurgical vessel 31 and a melting cyclone 38. Details of the melting cyclone are not shown. The metallurgical vessel itself comprises a lower portion 32 which accommodates the iron bath 39 and part of the slag layer 36 and comprises at least one tap hole 41 for tapping off molten iron and slag. The vessel also comprises an upper portion 33, which accommodates the remainder of the slag layer 36, and a roof portion 34. The slag layer 36 thus rests on top of the iron bath 39 and extends from the lower portion of the vessel 32 into the upper portion 33. Pre-reduced iron oxide 40 falls or flows from the melting cyclone into the metallurgical vessel and is finally reduced in the slag layer. A plurality of lances 35 supply oxygen containing gas to the slag layer 36 in the upper portion 33 of the vessel. Two lances are shown in the figure but more may be present depending on, for example, the size of the vessel and the performance parameters of the lances. A plurality of tuyeres 37 are arranged around the circumference of the lower portion of the vessel. The tuyeres are suitable for supplying gas and/or liquid and/or solids (such as recycled dust) and/or plasma to the slag layer in the lower portion 32 of the vessel. The number of tuyeres arranged around the circumference of the lower part of the vessel can be varied depending on the size of the vessel and the performance parameters of the tuyeres. The tuyeres may comprise oxy-fuel burners. During the final reduction of the pre-reduced iron oxide a process gas comprising reducing CO is produced that is partially post-combusted above the slag layer 36 in the vessel 31, whereby heat needed for the final reduction is released. The reducing process gas rises and is further post-combusted in the melting cyclone 38 with oxygen containing gas supplied to the melting cyclone. Iron oxide supplied to the melting cyclone is pre-reduced approximately to FeO and at least partly melted in the melting cyclone. The pre-reduced iron oxide 40 then falls or flows down into the metallurgical vessel 31. While the invention has been illustrated by a particular embodiment, variations and modifications are possible within the scope of the inventive concept.

The invention claimed is:

1. Metallurgical vessel for iron and steel making comprising a bottom portion, a sidewall, a roof having an inner perimeter defining a center opening, and a lance arrangement of at least three lances for supplying oxygen containing gas to the interior of the vessel in operation, each lance extends through the roof;

and has a discharge end in the interior of the vessel directed for discharging the oxygen containing gas downwardly into the interior of the vessel and downwardly entraining post combusted gases;

each lance has a corresponding feed chute for adding therethrough particulate material to the vessel in the substantially downwardly directed flow of post-combusted gases, each feed chute having a feed chute discharge end for the adding of particulate material to the vessel, each feed chute projects through the roof of the metallurgical vessel;

each feed chute is positioned for passing the solids downwardly through the roof between a respective said lance and the sidewall of the metallurgical vessel in a radial direction, wherein each lance comprises a discharge end for emitting oxygen containing gas, wherein the lance arrangement comprises said at least three lances, the lances projecting into the upper portion of the vessel, wherein at least one of the lances is provided with means for emitting a plurality of jets of oxygen containing gas from its end, wherein at least one lance is arranged for directing the oxygen containing gas towards a central axis of the metallurgical vessel, wherein each chute discharge end is at an elevation above an elevation of the corresponding lance discharge end;

the lance discharge end not extending into a region of the vessel interior below the center opening, wherein the lance discharge end is positioned and directed for achieving in operation a substantially downwardly directed flow of post-combusted gases at the side wall of the vessel and a substantially upwardly directed flow of post-combusted gases in the center of the vessel.

2. Metallurgical vessel according to claim 1, wherein at least one of the lances is inclined from the vertical under a first acute angle with its end portion inclined towards the central axis of the metallurgical vessel.

3. Metallurgical vessel according to claim 2, wherein the end portion of the lance is configured to direct the oxygen containing gas towards the central axis of the metallurgical vessel under a second acute angle from the vertical which second acute angle is greater than the first acute angle.

4. Metallurgical vessel according to claim 1, wherein the end portions of the lances are all of equal distance from the sidewall.

5. Metallurgical vessel according to claim 1, wherein at least one of the lances is adjustably in height.

6. Metallurgical vessel according to claim 1, further comprising a melting cyclone extending from the roof center opening, the lances positioned to avoid contact with molten material passing downwards from the melting cyclone to the metallurgical vessel.

7. Metallurgical vessel according to claim 1, wherein the sidewall comprises a lower portion for accommodating a molten metal bath and a slag layer and an upper portion for accommodating a slag layer and wherein the at least three lances for supplying oxygen containing gas to the upper portion of the vessel project into the upper portion of the vessel and wherein a plurality of tuyeres for supplying gas and/or liquid and/or solids and/or plasma into the slag layer in the lower portion of the vessel are arranged around the circumference of the lower portion of the vessel, wherein the tuyeres comprise oxy-fuel burners.

8. Metallurgical vessel according to claim 7, wherein the diameter of the lower portion of the vessel is smaller than that of the upper portion.

9. Metallurgical vessel according to claim 1, comprising a melting cyclone positioned above and in open connection with the metallurgical vessel.

10. Metallurgical vessel according to claim 9, wherein the lances are positioned to avoid contact with molten material passing downwards from the melting cyclone to the metallurgical vessel.

* * * * *